United States Patent [19]

Schelshorn et al.

[11] Patent Number: 4,752,145

[45] Date of Patent: Jun. 21, 1988

[54] VARIABLE LENGTH PAPER GUIDE FOR PAPER TRACTORS IN PRINTER FACILITIES

[75] Inventors: Lorenz Schelshorn, Augsburg; Gerhard Turini, Maisach, both of Fed. Rep. of Germany

[73] Assignee: Siemens Aktiengesellschaft, Berlin and Munich, Fed. Rep. of Germany

[21] Appl. No.: 881,807

[22] Filed: Jul. 3, 1986

[30] Foreign Application Priority Data

Jul. 4, 1985 [DE] Fed. Rep. of Germany ..... 3524010

[51] Int. Cl.[4] ..... B41J 11/32

[52] U.S. Cl. ..... 400/616; 400/616.3; 400/651; 29/124; 29/126; 29/130; 226/194; 226/199

[58] Field of Search ..... 282/21 D; 226/194, 196, 226/199; 400/650, 651, 616, 616.1, 616.3; 29/121.1, 124, 125, 126, 130

[56] References Cited

U.S. PATENT DOCUMENTS

| | | | |
|---|---|---|---|
| 2,113,579 | 4/1938 | Dybvig | 400/616.1 |
| 2,393,471 | 1/1946 | Johnson | 400/616.3 |
| 3,799,313 | 3/1974 | Shevick | 400/616.1 |
| 3,877,368 | 4/1975 | Madigan | 101/348 |
| 4,358,039 | 11/1982 | Buzzell | 400/616.3 |
| 4,971,896 | 9/1984 | Milane, Jr. | 400/616.1 |

FOREIGN PATENT DOCUMENTS

| | | | |
|---|---|---|---|
| 1966714 | 1/1974 | Fed. Rep. of Germany . | |
| 2743199 | 4/1979 | Fed. Rep. of Germany . | |
| 3141458 | 9/1983 | Fed. Rep. of Germany . | |
| 506068 | 5/1939 | United Kingdom | 400/681 |
| 2104623 | 3/1983 | United Kingdom . | |

*Primary Examiner*—William Piepaz

*Attorney, Agent, or Firm*—Hill, Van Santen, Steadman & Simpson

[57] ABSTRACT

The device for paper guidance in printing facilities comprising a paper tractor that transports continuous form paper comprises a plurality of paper guide elements displaceably arranged on a transport shaft dependent on the width of the paper. Compression springs that are supported on the paper guide elements are arranged between the paper guide elements. The hollow-cylindrically fashioned paper guide elements are interrupted in denticular fashion at their surface areas, whereby the respectively neighboring toothings of the paper guide elements displaceably mesh via their teeth in order to thus form a variable-width paper guide cylinder.

12 Claims, 1 Drawing Sheet

VARIABLE LENGTH PAPER GUIDE FOR PAPER TRACTORS IN PRINTER FACILITIES

BACKGROUND OF THE INVENTION

1. Field of the Invention

The invention relates to a device for paper guidance in printer facilities having a plurality of paper guide elements selectively displaceably arranged on a transport shaft, dependent on the width of the paper.

2. Description of the Prior Art

Paper tractors which can be adjusted dependent on the width of the paper to be employed are generally known for the transport of continuous form papers in printer facilities and are disclosed, for example, in German AS No. 19 66 714. The paper tractors thereby comprise pinfeed wheels as transport elements which are seated in displaceable and lockable fashion on a square transport shaft. Paper guide elements fashioned as paper rolls are likewise displaceably arranged between the pinfeed wheels. Margin-perforated fanfold paper is thereby employed as the paper to be printed.

Due to the sag of the unsupported paper, disturbances in the paper running, for example crumpling, skewed running, etc., can occur between the narrow paper guide elements when processing such a margin-perforated fanfold paper with pinfeed wheels. For adjustment to the appropriate paper width, the paper guide elements must also be disadvantageously displaced one by one on the transport shaft in addition to the pinfeed wheels.

SUMMARY OF THE INVENTION

An object of the invention is to fashion a paper guide of the type described above such that the paper is supported over the full width of the paper guide independently of the width of adjustment.

Given a device of this type, this object as achieved by the use of compression springs arranged between the guide elements.

The paper guide elements of the invention are formed hollow-cylindrically as plastic bushings and include toothings on their surface areas. The toothings interengage with their teeth and are fashioned such that a closed cylinder is formed via the plastic bushings given the smallest required width of adjustment. Given larger widths of adjustment up to the largest width of adjustment, these elements form a quasi-closed paper supporting cylinder over a great range of adjustment, this supporting cylinder being interrupted only by the apertures of the toothing. As soon as the width of adjustment becomes so large that the overlap length of the bushing walls is exceeded, a significantly enlarged seating surface for the paper is obtained with this arrangement in comparison to traditional, narrow paper transport rolls, whereby the appropriately dimensioned compression springs likewise serve as supports for the paper.

The diameter of the compression springs differs from the outside diameter of the paper guide elements designed as plastic bushings only on the basis of the wall thickness of the latter. The effect of the compression springs is that the paper guide elements automatically adjust to equal spacings from one another in an advantageous way, whereby, given a suitable selection of the spring parameters of the compression springs, it can be achieved that the increase in the width of adjustment from the minimum up to the maximum adjusted width is automatically accomplished after a clamp interlock has been released.

BRIEF DESCRIPTION OF THE DRAWINGS

An embodiment of the invention is shown in the drawings and shall be set forth in greater detail below by way of example. Shown therein are.

DESCRIPTION OF THE PREFERRED EMBODIMENTS

Figure 1:
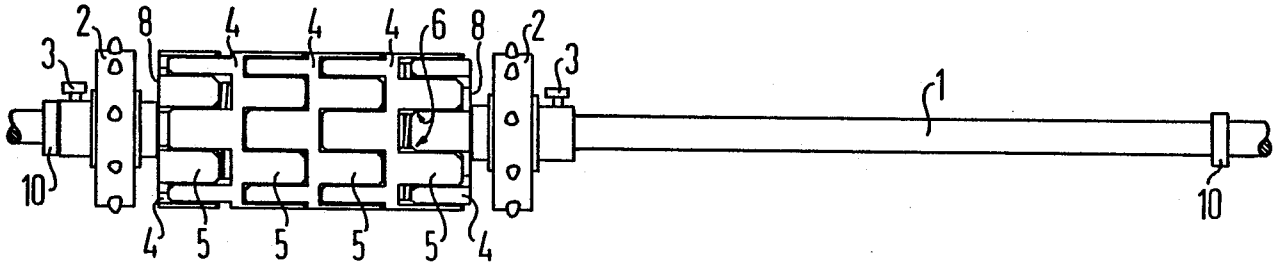
FIG. 1 is a side view of the paper guide in its nonextended condition.

A paper tractor for the transport of continuous form paper as disclosed, for example, in German AS No. 19 66 714 is arranged in a printer facility (not shown in detail here), for example a line printer means with matrix print head as employed, for instance, in conjunction with communications terminal equipment.

The paper tractor comprises two pinfeed wheels 2 displaceably arranged on a motor-driven paper square transport shaft 1. The pinfeed wheels can be locked to the paper transport shaft 1 via a clamp means 3 that is designed, for example, as knurled screws. Hollow-cylindrically fashioned paper guide elements 4 are displaceably arranged on the paper transport shaft 1 between the pinfeed wheels, these elements 4 being interrupted in denticular fashion at their surface areas. The toothings of the paper guide elements 4 are thereby fashioned such that teeth 5 of the adjacent toothings respectively engage into one another. In order to facilitate the interengagement, the teeth 5 are provided with guide bevels 6 at their ends. Compression springs 7 are arranged between the paper guide elements 4 and their toothings 5 forming a hollow cylinder, these compression springs being supported on bearing surfaces 8 which are rigidly connected to the paper guide elements 4 and are centrally arranged between the toothings of the paper guide elements. In accord with the transport shaft 1, these bearing surfaces comprise square bearing recesses (not shown here).

With respect to their toothings 5, the paper guide elements 4 are dimensioned such that, in accord with the illustration in FIG. 1, the meshing of the toothings 5 forms a continuous paper guide cylinder at the smallest paper width to be set.

Figure 2:
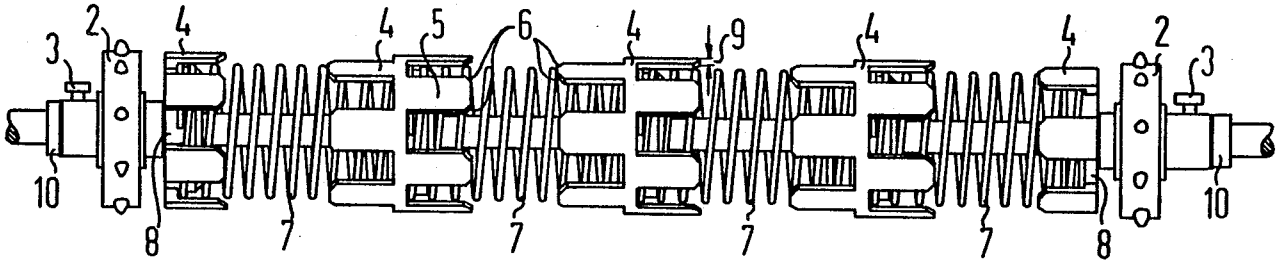
FIG. 2 is a side view of the paper guide in its extended condition.

After the clamp elements 3 which are designed here as knurled screws have been loosened, the paper guide elements 4 with their toothings 5 are pressed apart by the pressure of the compression spring elements 7 and form a continuous paper guide cylinder up to the point they reach the overlap length of the toothing 5. After this overlap length has been exceeded and up to a maximum width of adjustment shown in accord with FIG. 2, the compression springs automatically correctly adjust the paper guide elements 4 at the proper spacing relative to one another between the pinfeed wheels 2. The compression springs 7 have a diameter that differs from the diameter of the paper guide elements 4 only on the basis of the thickness 9 of the surface area of the paper guide elements. The helical compression springs 7 thus act as support elements between the paper guide elements 4.

Independently of the adjusted width which, for example, is limited by detents 10, the described device forms a quasiclosed paper supporting cylinder. The individual paper guide elements are thereby manufactured of one piece in a plastics injection molding method. The compression springs are composed of standard spring steel.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A device for paper guidance in printer facilities having a plurality of paper guide elements selectively displaceably arranged on a transport shaft dependent on the width of the paper comprising: compression springs arranged between the paper guide elements; said paper guide elements being formed as hollow cylinders and having an outer guidance suface with circumferentially spaced, longitudinally extending teeth projecting from each axial end of said elements, whereby neighboring paper guide elements displaqeably mesh via their teeth, so that they form a variable-width paper guide cylinder.

2. A device according to claim 1, wherein said teeth include guide bevels in the region of their ends for facilitating interengagement of said tooth.

3. A device according to claim 1, wherein the compression springs are fashioned as helical springs which are seated in the hollow cylinders formed by said teeth and are dimensioned in accord with the inside diameter of the hollow cylinder.

4. A device according to claim 1, wherein the paper guide elements are fashioned of plastics by injection molding.

5. A device according to claim 1, wherein the paper guide elements are guided on the transport shaft secured against twisting.

6. A device according to claim 5, wherein said transport shaft has a polygonal shape to secure said guide elements against twisting.

7. A device for guiding paper in a printer which has a plurality of paper guide elements displaceably arranged on a transport shaft comprising:

said paper guide elements being formed as hollow cylindrical bushings having an interior bearing surface and an outer paper guiding surface containing circumferentially spaced teeth, said teeth extending longitudinally along the length of said transport shaft; and compression springs carried on said shaft between said guide elements and below said guiding surface, said springs abutting against said bearing surfaces; whereby said spaced teeth of each guide element inter engage with the spaced teeth of adjacent guide elements, said guide elements being evenly spaced on said transport shaft by said springs, to form a variable width paper guide cylinder.

8. A device according to claim 7, wherein said teeth include guide bevels at their ends to facilitate inter engagement with the teeth of adjacent guide elements.

9. A device according to claim 7, wherein said compression springs are formed as helical springs which have an outer diameter just slightly smaller than an inside diameter of said hollow cylindrical bushing.

10. A device according to claim 7, wherein said guide elements are formed of injection molded plastic.

11. A device according to claim 7, whereinsaid guide elements are prevented from twisting while carried on said shaft.

12. A device according to claim 11, wherein said transport shaft has a polygonal cross sectional shape to secure said guide elements against twisting.

* * * * *